United States Patent [19]

Eberly, Jr.

[11] Patent Number: 4,592,829

[45] Date of Patent: Jun. 3, 1986

[54] DESULFURIZATION OF HYDROCARBONS

[75] Inventor: Paul E. Eberly, Jr., Baton Rouge, La.

[73] Assignee: Exxon Research and Engineering Co., Florham Park, N.J.

[21] Appl. No.: 686,453

[22] Filed: Dec. 26, 1984

[51] Int. Cl.[4] ..... C10G 25/00; C10G 35/09; C10G 45/08

[52] U.S. Cl. ..... 208/89; 208/91; 208/135; 208/139; 208/244; 502/406; 502/517

[58] Field of Search ..... 208/89, 244, 133, 138, 208/135, 139, 91; 502/517, 406, 400

[56] References Cited

U.S. PATENT DOCUMENTS

| | | | |
|---|---|---|---|
| Re. 29,771 | 9/1978 | Cull et al. | 502/406 |
| 2,491,694 | 12/1949 | Stiles | 502/517 |
| 2,697,078 | 12/1954 | Hendel | 502/517 |
| 2,951,034 | 8/1960 | Stuart | 208/244 |
| 3,199,946 | 8/1965 | Fujita et al. | 502/406 |
| 3,674,707 | 7/1972 | Pieters et al. | 502/517 |
| 3,728,252 | 4/1973 | Pitchford | 208/244 |
| 4,089,809 | 5/1978 | Farrior, Jr. | 502/406 |
| 4,344,842 | 8/1982 | Fox | 208/244 |
| 4,419,224 | 12/1983 | Miller et al. | 208/91 |
| 4,446,005 | 5/1984 | Eberly, Jr. et al. | 208/91 |
| 4,464,252 | 8/1984 | Eberly, Jr. et al. | 208/244 |

*Primary Examiner*—John Doll
*Assistant Examiner*—Anthony McFarlane
*Attorney, Agent, or Firm*—Llewellyn A. Proctor

[57] ABSTRACT

A process for the use of such sorbent, or catalyst, to effectively remove sulfur from naphthas at temperatures above about 350° F. without the significant production, if any, of PNA's. The invention embodies a particulate mass of a sorbent, or catalyst, comprised of nickel in concentration ranging from about 10 percent to about 70 percent, preferably from about 20 percent to about 50 percent, calculated as metallic nickel based on the total weight of the sorbent, iron in concentration ranging from about 1 percent to about 15 percent, preferably from about 2 percent to about 10 percent, calculated as metallic iron based on the total weight of the sorbent, or catalyst composition and a porous, refractory inorganic oxide such as silica, alumina, clays, or mixture thereof; preferably alumina, with which the nickel and iron are composited.

13 Claims, 1 Drawing Figure

FIGURE
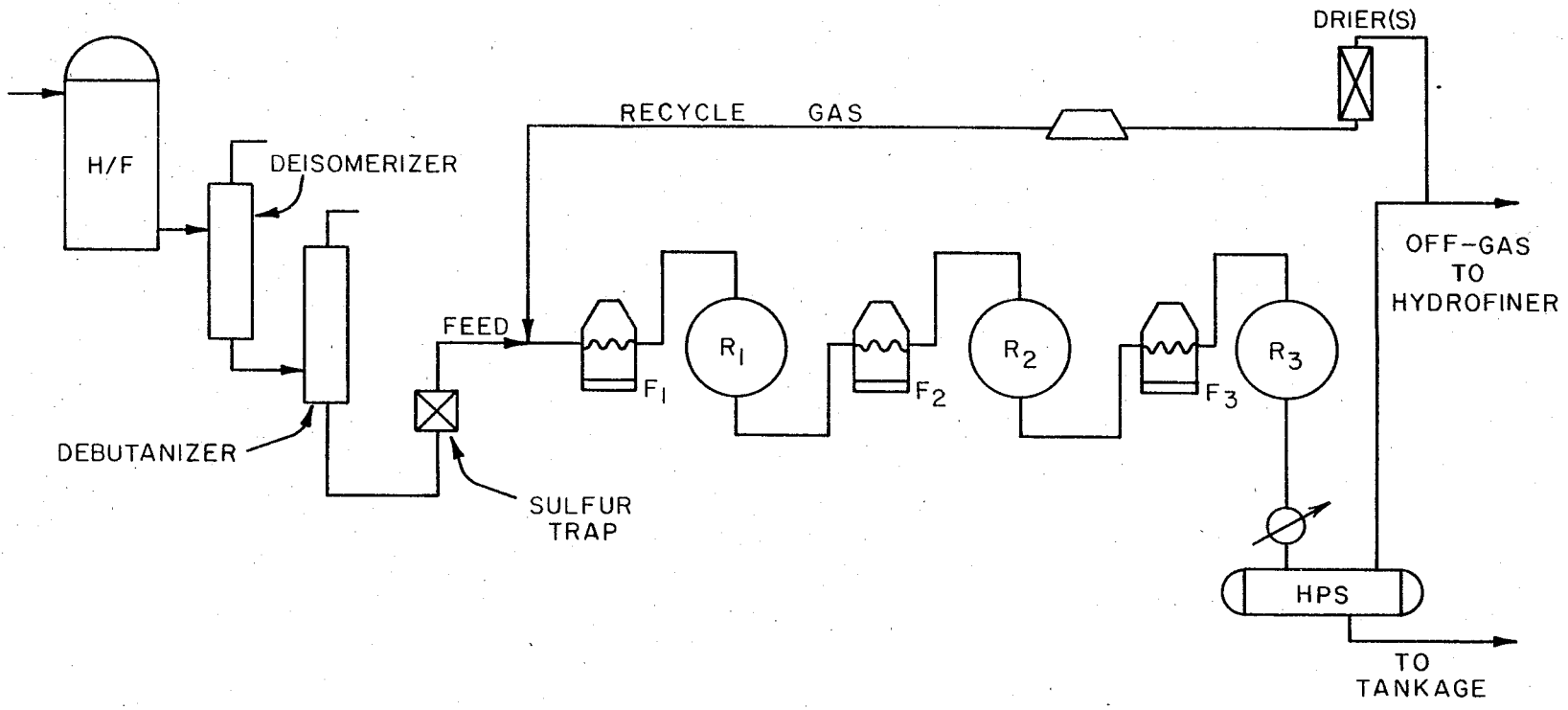

DESULFURIZATION OF HYDROCARBONS

BACKGROUND OF THE INVENTION (1) Field of the Invention

A process for the desulfurization of sulfur-containing hydrocarbon feedstocks, especially reformer feedstocks. In particular, it relates to a process for the removal of sulfur from hydrofined reformer feedstocks, without reduction in the temperature of the feedstock as received from the hydrofiner, via the use of an adsorbent, or sorbent.

(2) Background and Prior Art

It is known to use sorbents for the removal of sulfur from process streams, including particularly hydrocarbon process streams. The nature and quality of such sorbents varies widely, particularly as relates to this capacity to remove a wide variety of sulfur species, viz., mercaptans, thiophenes, disulfides, thioethers, hydrogen sulfide, carbonyl sulfide, and the like. Such sorbents, in particular, are not especially suitable for the essentially complete removal of sulfur from process streams, as required in some operations, e.g., catalytic reforming, or hydroforming, a well-known and important process employed in the petroleum refining industry for improving the octane quality of naphthas and straight run gasolines.

The presence of sulfur even in a small and virtually infinitesmal concentrations can have a detrimental effect in reforming. In a typical reforming process, a series of reactors of the reforming unit are each provided with fixed beds of sulfided catalyst which are sequentially contacted with a naphtha feed, and hydrogen at high severities, e.g., at high temperatures and low pressures. Each reactor is provided with a preheater, or interstage heater, because the reactions which take place are endothermic, and the temperature between the several reactors is progressively increased. In use of the more recently developed polymetallic platinum catalysts wherein an additional metal, or metals, hydrogenation-dehydrogenation (hydrogen transfer) component is added as a promoter to the platinum, it is, in fact, essential to reduce the feed sulfur to only a few parts, per million parts by weight of feed (wppm), because of the extreme sulfur sensitivity of these catalysts. For example, in the use of platinum-rhenium catalysts it is generally necessary to reduce the sulfur concentration of the feed well below about 2 wppm, and preferably below about 0.5 wppm, or even less than about 0.1 wppm to avoid excessive loss of catalyst activity and $C_5+$ liquid yield.

In most, if not all, commercial reforming operations, a sulfur-containing straight run gasoline, or naphtha, is first hydrofined (or hydrodesulfurized) to remove a preponderance of the sulfur, and the desulfurized feed than reformed. In the hydrofiner a sulfur-containing straight-run gasoline, or naphtha, is contacted with hydrogen, over a Group VIB and/or Group VIII metal catalyst, e.g., cobalt molybdate or nickel molybdate supported on alumina, at conditions sufficient to remove a preponderance of the sulfur as hydrogen sulfide, and the liquid product recovered for use as feed to the reformer. The efficiency of such units are limited by equilibrium or kinetic considerations and unfortunately the hydrofiner cannot reduce the sulfur levels to the amounts that are desired, or required; which may be on the order of 2 wppm, 0.5 wppm, or even 0.1 wppm, or less. Moreover, even if hydrofiners were capable of such effective operation, they are not capable of such operation 100 percent of the time. Upsets can and do occur. Typically, the naphtha feed will contain as much as 5 wppm to about 50 wppm, or more, of sulfur; and, if upsets occur, the feed during some portions of an operating cycle will contain even higher amounts of sulfur. These relatively high levels of feed sulfur will not only seriously adversely affect the level of $C_5+$ liquid yield production and decrease the activity of the catalyst when sulfur-sensitive polymetallic platinum catalysts are used, but may also poison the catalyst such that regeneration of the catalyst may become necessary prior to its further, continued use.

Sorbent or catalyst packed guard chambers, or vessels filled with sorbents or catalysts, consequently have been used to remove additional sulfur from hydrofined products prior to their use as reformer feeds. Massive nickel catalysts, e.g., nickel on a silica-alumina support, have been particularly effective in removing sulfur from hydrofined products, or naphthas at temperatures ranging below about 350° F. Higher temperatures than about 350° F. cannot be used for the removal of sulfur from naphthas with massive nickel catalysts, however, because the production of fused multi-ring aromatics or polynuclear aromatic compounds (PNA's) in the naphtha becomes excessive. The presence of PNA's are undesirable, not only in that they cause deactivation of reformer catalysts, but they are also primarily responsible for the octane requirement increase (ORI) known to occur in automobile engines. In brief, ORI is caused by the build-up of carbonaceous deposits in internal combustion engines (particularly old engines) which, by limiting heat transfer from the combustion chamber, leads to preignition. Preignition causes the phenomenon known as engine knock or ping which is "cured" by burning higher octane gasolines. The PNA's are major contributors to the build-up of carbon deposits over the lifetime of an engine, which leads to ORI. Dependent on gasoline composition, the ORI can be as small as 1–2 octane numbers or as great as 10–12 octane numbers.

In many refineries, the naphtha feed from the hydrofiner is available at temperatures far in excess of 350° F., e.g., 500° F. and higher, and whereas expensive heat exchange processes might be employed to reduce the temperature to 350° F., or less, the naphtha, after such treatment, would have to be reheated to the temperature required for reforming. This step is obviously quite burdensome, particularly in these times of increasing fuel costs. Hence, there is a particular need for a sorbent, or catalyst, useful for removing sulfur at temperatures above about 350° F., or at temperatures ranging about above 350° F. up to reforming temperatures; temperatures which normally produce excessive PNA's.

OBJECTS

It is accordingly the primary objective of this invention to fill this need; and, in particular, it is an objective to provide a sorbent, or catalyst, and process for the use of such sorbent, or catalyst, to effectively remove sulfur from naphtha at temperatures above about 350° F. without the significant production, if any, of PNA's.

A particular object is to provide a novel, and improved nickel sorbent, or catalyst, and process for the use of such sorbent, or catalyst, to effectively remove sulfur from naphthas at temperatures above about 350° F. without the significant production of PNA's.

A further, and yet more specific object is to provide a process for lowering the sulfur content of a hydrofined naphtha to less than about 2 wppm sulfur, preferably below about 0.5 wppm sulfur, and more preferably below about 0.1 wppm sulfur, without significant reduction of its temperature as removed from the hydrofiner, without the formation of excessive amounts of PNA's.

THE INVENTION

These objects and others are achieved in accordance with the present invention, which embodies (A) a particulate mass of a sorbent, or catalyst, comprised of nickel in concentration ranging from about 10 percent to about 70 percent, preferably from about 20 percent to about 50 percent, calculated as metallic nickel based on the total weight of the sorbent, iron in concentration ranging from about 1 percent to about 15 percent, preferably from about 2 percent to about 10 percent, calculated as metallic iron based on the total weight of the sorbent, or catalyst composition, and a porous, refractory inorganic oxide such as silica, alumina, clays, or mixture thereof; preferably alumina, with which the nickel and iron are composited; and (B) a process wherein a hydrocarbon stream which contains sulfur, sulfur compounds, and the like, is contacted with a particulate mass of the sorbent, or catalyst composition characterized in (A), supra, and said sulfur, sulfur compounds and the like, are adsorbed onto said particulate mass of sorbent or catalytic composition, and the process stream thereby denuded of said sulfur, sulfur compounds, and the like.

In a preferred embodiment, a particulate mass of the sulfur sorbent is charged, or packed into a guard chamber, or plurality of guard chambers and employed downstream of a hydrofiner for removing sulfur from a naphtha hydrofiner product. Suitably, where a plurality of guard chambers are used, the guard chambers are employed in series, one behind the other in tandem relationship, or in parallel downstream of the hydrofiner. The sulfur-containing naphtha product from the hydrofiner, constituting a reformer feed, is introduced into the guard chamber, or guard chambers, the sulfur-containing naphtha product from the hydrofiner being passed therethrough, the naphtha being thereby denuded of sulfur, and the sulfur-denuded naphtha product then employed as feed to the reforming, or hydroforming unit. It has been found that sulfur can be effectively removed from a hydrofined naphtha containing up to about 20 wppm sulfur, or even up to about 50 wppm sulfur, and higher, to provide a naphtha reformer feed containing less than about 2 wppm sulfur, or less than about 0.5 wppm sulfur, and even less than about 0.1 wppm sulfur, by contacting the hydrofined naphtha product with the contact mass at temperatures ranging above about 350° F., preferably from about 500° F. to about 850° F., more preferably from about 700° F. to about 800° F. The sulfur is effectively removed from the hydrofined naphtha, and at the same time there is a minimum of polynuclear aromatics produced, and transported with the naphtha feed to the catalyst packed reactors of the reforming unit.

These features and others will be better understood by reference to the following more detailed description of the invention, and to the drawing to which reference is made.

In the drawing:

The FIGURE depicts, by means of a simplified flow diagram, the use of a nickel/iron sorbent packed guard chamber or "sulfur trap" downstream of a hydrofiner, between said hydrofiner and reforming unit.

Referring to the FIGURE, generally, there is depicted a hydrofiner, H/F, and reforming unit inclusive of multiple on-stream reactors $R_1$, $R_2$, and $R_3$ each of which is provided with a fixed bed of a sulfur sensitive polymetallic platinum catalyst. A separate furnace, or heater $F_1$, $F_2$, and $F_3$, respectively, is connected in series with the reactors, $R_1$, $R_2$, and $R_3$ so that feed can be passed in seratim through $F_1R_1$, $F_2R_2$, and $F_3R_3$. Pumps, compressors and other auxiliary equipment are omitted for clarity. A deisomerizer, debutanizer, and guard chamber, or sulfur trap are located between the hydrofiner H/F and the reforming unit.

A hydrofined petroleum or synthetic naphtha feed from hydrofiner H/F is passed serially through the deisomerizer and debutanizer, and the partiallyd desulfurized feed then passed through the sulfur trap wherein essentially the balance of the sulfur is removed. Then, the desulfurized naphtha feed, with hydrogen, is passed through the $F_1R_1$, $F_2R_2$, and $F_3R_3$ with the products from the reactions being passed to a high pressure separator HPS. A portion of the hydrogen-rich make gas can be taken from the top of the high pressure separator HPS and, after passage through a make gas compressor, recycled to the hydrofiner, H/F, and another portion recycled through gas driers to the lead furnace and reactor $F_1R_1$. Substantially all, or a major portion of the moisture and sulfur can be scrubbed and removed from the recycle gas by the recycle gas drier to maintain a dry, low-sulfur system. $C_5$+ liquids from the bottom of high pressure separator HPS are sent to a stabilizer, or to tankage.

The feed which is hydrofined to provide the reformer feedstock is constituted of a naphtha, whether a virgin naphtha, straight run gasoline, thermally or catalytically cracked naphtha or the like, or blends thereof, which boils within a range for about 80° F. to about 450° F., preferably from about 150° F. to about 430° F. In these complex hydrocarbon mixture the predominant hydrocarbons have from about 5 to 12 carbon atoms, more typically from about 6 to about 9 carbon atoms. Typically, such a gasoline will contain from about 15 vol. % to about 20 vol. % paraffins, naphthenes, and branched paraffins, which fall within a range of from about $C_5$+ to about $C_{12}$, from about 15 vol. % to about 20 vol. % of olefins which fall within a range of from about $C_6$ to about $C_{12}$, and from about 60 vol. % to about 70 vol. % of aromatics, the preponderance of which fall within a range of from about $C_6$ to about $C_{12}$. Most of the gasoline that are used for motor vehicles are derived from petroleum, but may also be derived in whole or in part from hydrocarbons obtained for synthetic sources. Such feeds, prior to hydrofining generally contain from about 300 wppm to about 10,000 wppm sulfur, or more typically from about 300 wppm to about 2000 wppm sulfur, as organo sulfur compounds.

The hydrofining operation is typically conducted at conditions of temperature, pressure, hydrogen flow rate, and liquid hourly space velocities correlated to provide the desired amount of conversion to convert the organo sulfur compounds to hydrogen sulfide. The sulfur-containing naphtha is introduced, with hydrogen, into a reactor provided with a catalyst comprised of a Group VIB metal, or metals, of the Periodic Table of the Elements (E. H. Sargent & Co., Copyright 1964 Dyna-Slide Co.), or a Group VIII metal, or metals, or both; inclusive particularly of the oxides and/or sulfides of such metals, and admixtures of Group VIB and Group VIII metals. The metals are preferably supported on a porous, refractory inorganic oxide base, e.g., alumina, silica, zirconia, titania, bauxite, or the like. The metal content of a catalyst suitably ranges from between about 2 to 25 weight percent. Suitable catalysts include cobalt-molybdate, chromic acid, nickel, iron, etc., which are deposited on carriers, such as alumina, or various other oxides, or gels. A suitable catalyst for the hydrofining process is, for example, an alumina-containing support with a minor proportion of molybdenum oxide and cobalt oxide. Sulfided nickel and tungsten on alumina as well as nickel-molybdenum on alumina can also be used. The hydrofining runs are conducted by adjusting the hydrogen and feed rates, and the temperature and pressure to the conditions desired to remove the desired amount of sulfur from the feed. The run is made by adjustment of the major process variables within the ranges described below:

| Major Operating Variables | Typical Process Conditions | Preferred Process Conditions |
|---|---|---|
| Pressure, psig | 100–700 | 200–700 |
| Reactor Temp. °F. | 400–850 | 700–850 |
| Hydrogen Gas Rate, SCF/B | >200 | 500–10000 |
| Liquid Hourly Space Velocity | 0.1–10 | 1–5 |

The effluent from the hydrofining zone is treated to remove hydrogen sulfide and ammonia from the hydrofined naphtha. Removal of hydrogen sulfide and ammonia may be accomplished, for example, by injecting water or alkylized water into the hydrofiner effluent and passing the resulting mixture into a separator operating under such conditions that a water phase containing essentially all the hydrogen sulfide and ammonia present in the effluent can be removed. Further, purification of the hydrofined feed can be accomplished by a stripper or a distillation column. Also, the hydrogen sulfide and ammonia can be removed by passing the hydrofiner effluent to a separator at a temperature and pressure whereby substantially only hydrogen sulfide, ammonia, and hydrogen are in the gaseous state. The liquid naphtha is thus easily separated from the gases. While it is essential to free the naphtha of hydrogen sulfide and ammonia, hydrogen dissolved in the naphtha presents no problem, but is desirable.

The hydrofined reformer feedstock, in the preferred operation, which generally contains from about 5 wppm to about 50 wppm of sulfur, of an even greater amount of sulfur as can occur during a hydrofiner upset, is introduced in the guard chamber, or guard chambers containing the nickel-iron catalyst of this invention, viz., at temperature ranging from about 300° F. to about 600° F., preferably from about 350° F. to about 500° F. Whereas essentially all hydrofined products contain some PNA's, substantially no new PNA formation occurs in the desulfurization reaction produced by the nickel-iron sorbent of this invention. The desulfurization reaction can be conducted with or without the addition of hydrogen to the nickel-iron sorbent-containing guard chamber, or guard chambers. The product removed from the guard chamber, or guard chambers, contains no more than about 2 wppm of sulfur; generally less than about 0.5 wppm of sulfur, and preferably less than 0.1 wppm (an unmeasurable amount) of sulfur.

The reforming catalyst is constituted of composite particles which contain, besides a carrier or support material, a hydrogenation-dehydrogenation component, or components, and a halide component. The support material is constituted of a porous, refractory inorganic oxide, particularly alumina. The support can contain, e.g., one or more of alumina, bentonite, clay, diatomaceous earth, zeolite, silica, activated carbon, magnesia, zirconia, thoria, an the like; through the most preferred support is alumina to which, if desired, can be added a suitable amount of other refractory carrier materials such as silica, zirconia, magnesia, titania, etc., usually in a range of about 1 to 20 percent, based on the weight of the support. A preferred support is one having a surface area of more than 50 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30 to 300 °A.

The metal hydrogenation-dehydrogenation component can be composited with or otherwise intimately associated with the porous inorganic oxide support or carrier by various techniques known to the art such as ion-exchange, coprecipitation with the alumina in the sol or gel form, and the like. For example, the catalyst composite can be formed by adding together suitable reagents such as a salt of platinum and ammonium hydroxide or carbonate, and a salt of aluminum such as aluminum chloride or aluminum sulfate to form aluminum hydroxide. The aluminum hydroxide containing the salts of platinum can then be heated, dried, formed into pellets or extruded, and then calcined in nitrogen or other non-agglomerating atmosphere. Other metal hydrogenation components can also be added to the catalyst in similar manner, or by impregnation.

It is preferred to deposite the platinum, or platinum and rhenium metals, or other metal or metals used as promoters, if any, on a previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

Platinum in absolute amount, is usually supported on the carrier within the range of from about 0.01 to 3 percent, preferably from about 0.2 to 1 percent, based on the weight of the catalyst (dry basis). Rhenium, in absolute amount, is also usually supported on the carrier in concentration ranging from about 0.1 to about 3 percent, preferably from about 0.2 to about 1 percent, based on the weight of the catalyst (dry basis). The absolute concentration of each for use in reactors is preselected to provide the desired ratio of rhenium:-platinum for a respective reactor of the unit. In compositing the metals with the carrier, essentially any soluble compound can be used, but a soluble compound which can be easily subjected to thermal decomposition and reduction is preferred, for example, inorganic salts such as halide, nitrate, inorganic complex compounds, or organic salts such as the complex salt of acetylacetone, amine salt, and the like. Where, e.g., platinum is to be deposited on the carrier, platinum chloride, platinum nitrate, chloroplatinic acid, ammonium chloroplatinate, potassium chloroplatinate, platinum polyamine, platinum acetylacetonate, and the like, are preferably used. A promoter metal, is added in concentration ranging from about 0.01 to 3 percent, preferably from about 0.05 to about 1 percent, based on the weight of the catalyst.

To enhance catalyst performance in reforming operations, it is also required to add a halogen component to the catalysts, fluorine and chlorine being preferred halogen components. The halogen is contained on the catalyst within the range of 0.1 to 3 percent, preferably within the range of about 0.6 to about 1.5 percent, based on the weight of the catalyst. When using chlorine as a halogen component, it is added to the catalyst within the range of about 0.2 to 2 percent, preferably within the range of about 0.6 to 1.5 percent, based on the weight of the catalyst. The introduction of halogen into the catalyst can be carried out by any method at any time. It can be added to the catalyst during catalyst preparation, for example, prior to, following or simultaneously with the incorporation of the metal hydrogenation-dehydrogenation component, or components. It can also be introduced by contacting a carrier material with a vapor phase or liquid phase containing a halogen compound such as hydrogen fluoride, hydrogen chloride, ammonium chloride, or the like.

The reforming operation is carried out by adjusting the hydrogen and feed rates, and the temperature and pressure to operating conditions. The run is made at optimum reforming conditions by adjustment of the major process variables, within the ranges described below:

| Major Operating Variables | Typical Process Conditions | Preferred Process Conditions |
|---|---|---|
| Pressure, psig | 50–500 | 100–300 |
| Reactor Temp., °F. | 800–1200 | 850–1050 |
| Recycle Gas Rate, SCF/B | 1000–10,000 | 1500–5000 |
| Feed Rate, W/Hr/W | 0.5–10 | 0.5–5 |

EXAMPLES

To illustrate the usefulness of this invention, several nickel containing catalysts were prepared by the techniques described above. These are listed as Catalyst A, B, and C in the table. Nickel to the extent of 50% by weight was supported on a silica/alumina base (15% $SiO_2$) and designated as Catalyst A. The same amount of nickel was then impregnated on a pure alumina base and designated Catalyst B. A portion of this latter catalyst was then impregnated with iron nitrate to produce an adsorbent containing 5% Fe in addition to the nickel already impregnated. This is designated as Catalyst C.

For testing, these materials in the form of 14–42 mesh particles were reduced with hydrogen at 500° F. The catalyst was then transferred under nitrogen to an autoclave and about 600 cc of a spiked petroleum naphtha added. This naphtha, originally sulfur free, was intentionally spiked with n-hepyl mercaptan so that 2850 ppm sulfur was present in this feedstock.

After closing, the autoclave was flushed with nitrogen, and the gas replaced with hydrogen for pressure testing. The run was started by heating to 500° F. while stirring at 1500 rpm. The pressure was adjusted to the desired level of 275 psig. After contacting overnight, the autoclave run was terminated. The naphtha liquid product was analyzed by UV spectroscopy to determine the relative amounts of polynuclear aromatics formed. This is shown by the amount of ultraviolet light absorbed at 319 mm in the table. High values reflect higher contents of PNA's. Also, the nickel catalyst was discharged and analyzed for sulfur by wet chemical techniques. Results are shown in the following table.

Sulfur Removal From Naphtha (500° F., 275 Psig, 2850 ppm Sulfur in Feed)

| Catalyst | Composition, Wt. % | Wt. % Sulfur on Adsorbent | UV Absorbance 319 mm |
|---|---|---|---|
| A | 50% Ni on $SiO_2/Al_2O_3$ | 14.5 | 2.32 |
| B | 50% Ni on $Al_2O_3$ | 10.7 | 0.82 |
| C | 50% Ni + 5% Fe On $Al_2O_3$ | | |

Catalysts of existing art are represented by Catalysts A and B. Catalyst A has a higher adsorption capacity of 14.5% sulfur but also produces a larger amount of PNA's as shown by the higher UV absorbence. By eliminating the silica, the UV absorbance is decreased but also a substantial loss in sulfur capacity is incurred as illustrated by the results with Catalyst B.

The material of this invention is that shown by Catalyst C. By incorporating iron to the extent of 5% by weight, the extent of PNA production is greatly inhibited. However, surprisingly, the ability of the material to adsorb sulfur is substantially increased to the extent of 18.8% by weight.

It is apparent that various modifications and changes can be made without departing from the spirit and scope of the present invention.

Having described the invention, what is claimed is:

1. A process for the removal of sulfur from a reformer feedstock containing from about 5 wppm to about 50 wppm, or more, of sulfur which comprises contacting said feedstock with a sorbent comprised of nickel in concentration ranging from about 10 percent to about 70 percent, calculated as metallic nickel based on the total weight of said sorbent, iron in concentration ranging from about 1 percent to about 15 percent, calculated as metallic iron based on the total weight of said sorbent, and a porous, refractory inorganic oxide, at temperatures ranging from about 350° F. to about 850° F., to produce a reformer feedstock containing no more than about 2 wppm sulfur.

2. The process of claim 1 wherein the sorbent contains from about 20 percent to about 50 percent nickel, and from about 2 percent to about 10 percent iron.

3. The process of claim 1 wherein the reaction is conducted at temperatures ranging to about 600° F.

4. The process of claim 3 wherein the reaction is conducted at temperatures ranging from about 350° F. to about 500° F.

5. The process of claim 1 wherein the reformer feedstock contains no more than about 0.5 wppm sulfur.

6. The process of claim 5 wherein the reformer feedstock contains no more than about 0.1 wppm sulfur.

7. In a process for reforming a sulfur-containing naphtha feed, wherein is included in combination, a hydrofiner which contains a metal catalyst, the metallic component of which is selected from Group VIB and Group VIII, with which the sulfur-containing naphtha feed is contacted with hydrogen, at reaction conditions inclusive of temperatures ranging from about 400° F. to about 850° F. to remove sulfur and provide a product naphtha which contains from about 5 wppm to about 50 wppm, and higher, sulfur, a guard chamber filled with a sorbent into which said partially desulfurized hydrofined naphtha is injected to flow therethrough to effect further removal of sulfur, and a reforming unit which contains a plurality of sulfur sensitive catalyst-containing on-stream reactors connected in series, the naphtha feed to which flows in sequence from one reactor of the series of another to contact the catalyst contained therein at reforming conditions, the improvement comprising maintaining within said guard chamber a sorbent comprised of nickel in concentration ranging from about 10 percent to about 70 percent, calculated as metallic nickel based on the total weight of said sorbent, iron in concentration ranging from about 1 percent to about 15 percent, calculated as metallic iron based on the total weight of said sorbent, and a porous, refractory inorganic oxide, at temperatures ranging above about 350° F., to produce a reformer feedstock containing no more than about 2 wppm sulfur.

8. The process of claim 7 wherein the sorbent maintained within said guard chamber contains from about 20 percent to about 50 percent nickel, and from about 2 percent to about 10 percent iron.

9. The process of claim 8 wherein the porous, refractory inorganic oxide with which the nickel and iron are composited is alumina.

10. The process of claim 7 wherein the feedstock contacted with said sorbent is maintained at temperatures ranging to about 600° F.

11. The process of claim 10 wherein the reaction is conducted at temperatures ranging from about 500° F. to about 800° F.

12. The process of claim 7 wherein the reformer feedstock contains no more than about 0.5 wppm sulfur.

13. The process of claim 12 wherein the reformer feedstock contains no more than about 0.1 wppm sulfur.

* * * * *